US009295889B2

(12) United States Patent
Conway

(10) Patent No.: US 9,295,889 B2
(45) Date of Patent: Mar. 29, 2016

(54) DISC THROWING GAME ASSEMBLY

(71) Applicant: Rory Conway, Sunset, UT (US)

(72) Inventor: Rory Conway, Sunset, UT (US)

( * ) Notice: Subject to any disclaimer, the term of this patent is extended or adjusted under 35 U.S.C. 154(b) by 75 days.

(21) Appl. No.: 14/322,988

(22) Filed: Jul. 3, 2014

(65) Prior Publication Data

US 2016/0001150 A1 Jan. 7, 2016

(51) Int. Cl.

*A63B 63/00* (2006.01)
*A63B 67/06* (2006.01)
*A63B 59/02* (2006.01)

(52) U.S. Cl.

CPC ..... *A63B 59/025* (2013.01); *A63B 63/00* (2013.01)

(58) Field of Classification Search

CPC ..... A63B 63/00; A63B 67/06
USPC ..... 473/476, 475, 477; 273/400, 338
See application file for complete search history.

(56) References Cited

U.S. PATENT DOCUMENTS 620,460 A * 2/1899 Lake ..... A63B 67/002 473/410
1,533,417 A * 4/1925 Holland ..... A63F 7/0628 273/317.2
2,006,497 A * 7/1935 Couse ..... A63B 67/002 273/118 R
3,348,846 A * 10/1967 Atchison ..... A63B 63/08 273/400
3,822,883 A 7/1974 De Vos
3,865,375 A * 2/1975 Cosgrove ..... A63B 63/00 273/118 R
4,373,734 A 2/1983 Frank
4,809,988 A * 3/1989 Hunter ..... A63B 57/0056 273/400
4,949,979 A 8/1990 Wheatcroft
5,356,132 A * 10/1994 McEwan ..... A63B 71/00 273/336
5,358,256 A * 10/1994 Kraemer ..... A63B 67/06 273/401
5,382,028 A * 1/1995 Sciandra ..... A63B 67/06 273/401
5,395,122 A * 3/1995 Kraemer ..... A63B 63/00 273/400
5,941,529 A 8/1999 Kinsey
5,944,318 A 8/1999 Payton
D419,211 S 1/2000 Lanham
6,659,466 B2 12/2003 Searles et al.
6,834,858 B1 * 12/2004 Reineke ..... A63B 63/00 273/400
8,075,425 B2 * 12/2011 Conwright ..... A63B 69/0071 473/422
8,967,624 B1 * 3/2015 Ingle ..... A63B 67/02 273/400
2004/0209712 A1 10/2004 Turng et al.
2008/0224409 A1 9/2008 Marshall et al.

FOREIGN PATENT DOCUMENTS

DE 3344955 6/1985
KR 1020110107974 10/2011

* cited by examiner

*Primary Examiner* — Gene Kim
*Assistant Examiner* — M Chambers

(57) ABSTRACT

A disc throwing game assembly allows for play of a disc throwing game combining aspects of disc golf, soccer and lacrosse. The game assembly includes a disc and a pair of goals. Each of the goals comprises a pair of straight sides and a pair of bases. Each of the bases is coupled to and extends from a distal end of an associated one of the straight sides relative to a junction of the straight sides. A net is coupled to a first end of an elongated staff. A scoop is coupled to a second end of the staff.

16 Claims, 3 Drawing Sheets

DISC THROWING GAME ASSEMBLY

BACKGROUND OF THE DISCLOSURE

Field of the Disclosure

The disclosure relates to game devices and more particularly pertains to a new game device for allowing play of a disc throwing game combining aspects of disc golf, soccer and lacrosse.

SUMMARY OF THE DISCLOSURE

An embodiment of the disclosure meets the needs presented above by generally comprising a disc and a pair of goals. Each of the goals comprises a pair of straight sides and a pair of bases. Each of the bases is coupled to and extends from a distal end of an associated one of the straight sides relative to a junction of the straight sides. A net is coupled to a first end of an elongated staff. A scoop is coupled to a second end of the staff.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
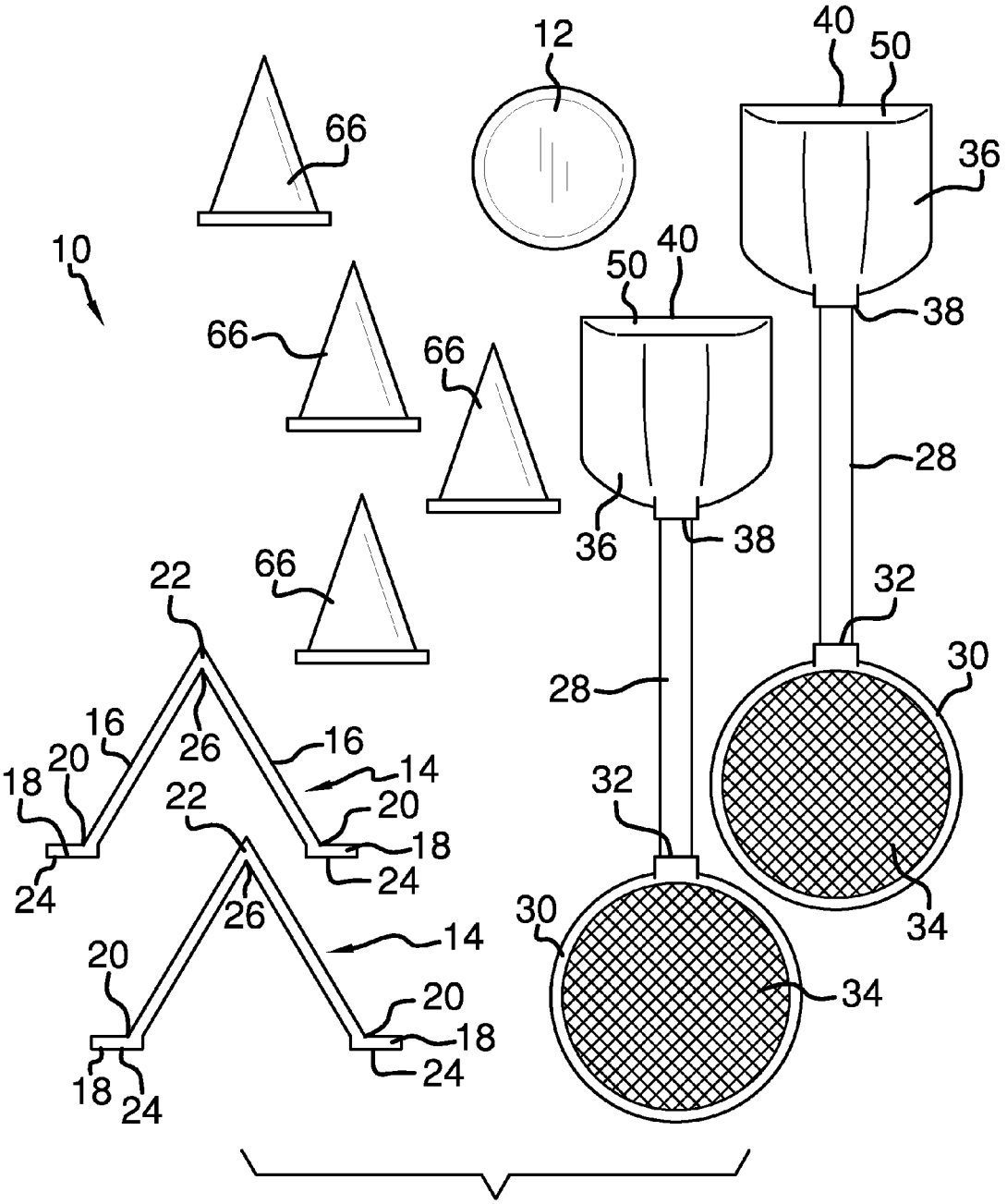
FIG. 1 is a front view of a disc throwing game assembly according to an embodiment of the disclosure.
Figure 2:
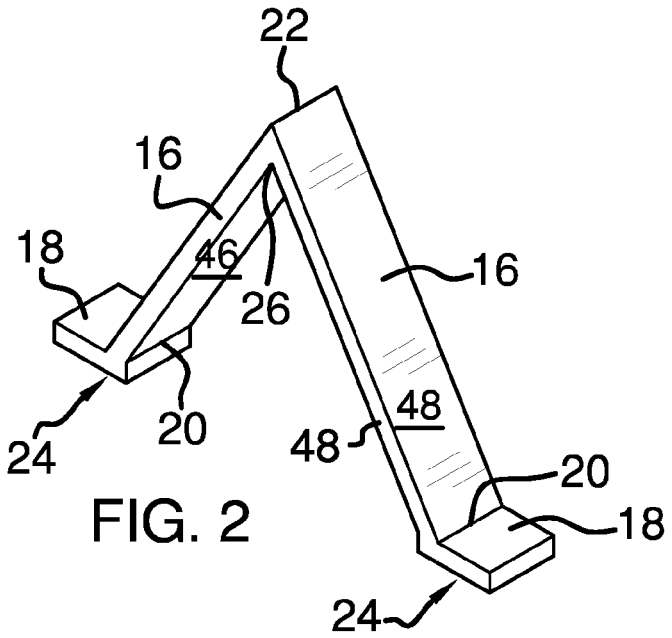
FIG. 2 is a top front side perspective view of a goal of an embodiment of the disclosure.
Figure 3:
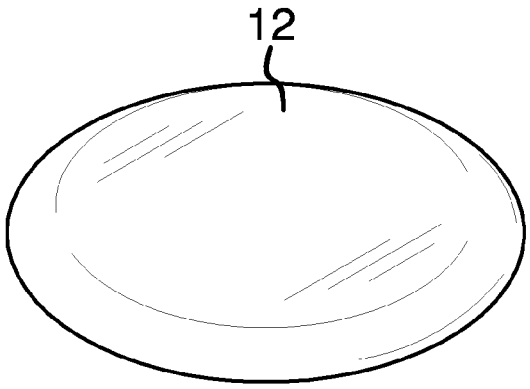
FIG. 3 is a top front side perspective view of a disc of an embodiment of the disclosure.
Figure 4:
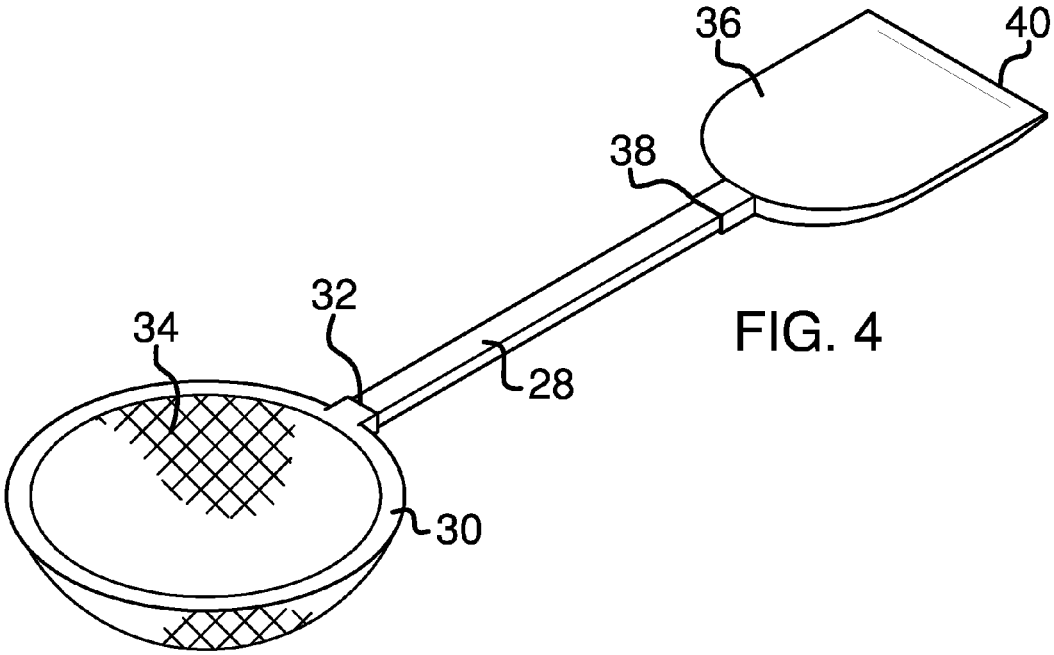
FIG. 4 is a top front side perspective view of a staff of an embodiment of the disclosure.
Figure 5:
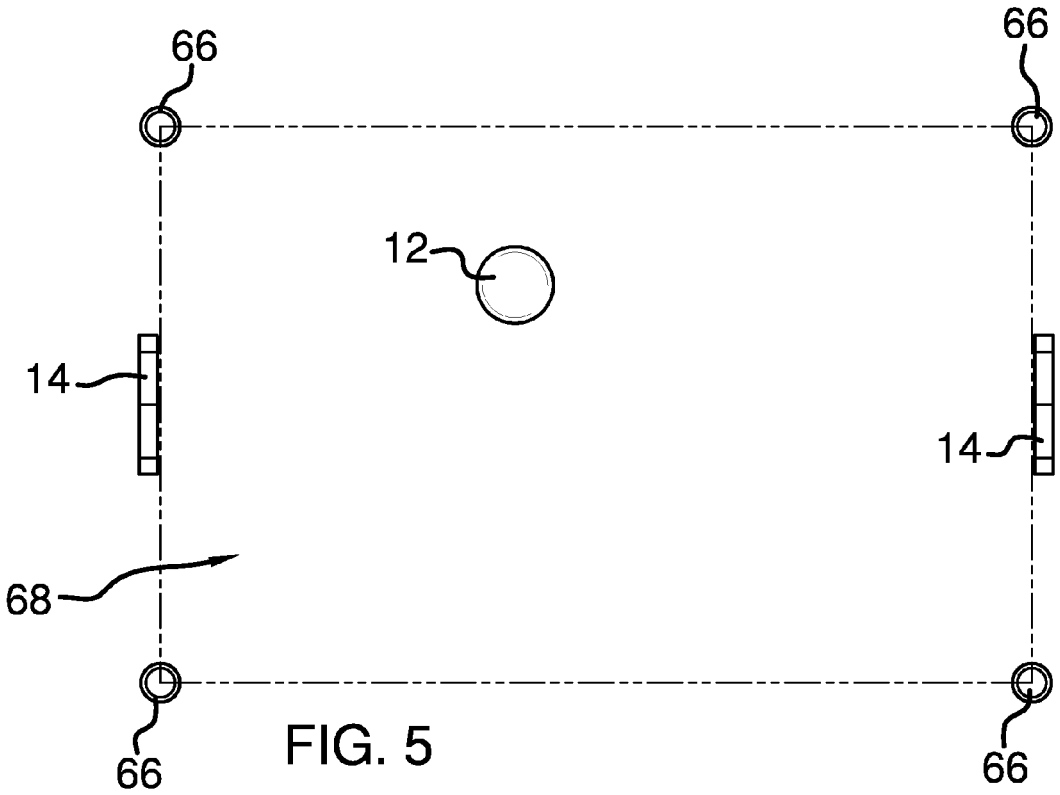
FIG. 5 is a top view of an embodiment of the disclosure.

With reference now to the drawings, and in particular to FIGS. 1 through 5 thereof, a new game device embodying the principles and concepts of an embodiment of the disclosure and generally designated by the reference numeral 10 will be described.

As best illustrated in FIGS. 1 through 5, the disc throwing game assembly 10 generally comprises a disc 12 having a diameter between 20 and 30 centimeters and a pair of goals 14. Each of the goals 14 comprises a pair of straight sides 16 and a pair of bases 18. Each of the bases 18 is coupled to and extends from a distal end 20 of an associated one of the straight sides 16 relative to a junction 22 of the straight sides 16. Each of the bases 18 is planar having a respective bottom surface 24. The bottom surfaces 24 of the bases 18 of each goal 14 is coplanar. Each goal 14 is substantially symmetrical having a mirror image across a plane through the junction 22. A distance between the distal ends 20 of the straight sides 16 of each goal 14 is slightly greater than the diameter of the disc 12. The distance between the distal ends 20 of the straight sides 16 of each goal 14 is between 25 and 35 centimeters. Each goal 14 further has an opening height measured transversely from a base plane defined by the bottom surfaces 24 of the bases 18 to an interior edge 26 of the junction 22 of the straight sides 16 of the goal 14. The opening height is also slightly greater than a diameter of the disc 12. The opening height of each goal 14 is between 25 and 35 centimeters and equal to the distance between the distal ends 20 of the straight sides 16 of the goal 14.

A staff 28 is elongated and is configured to be grasped by a person playing a game with the game assembly 10. A frame 30 is coupled to a first end 32 of the staff 28. The frame 30 is circular and has a diameter greater than the diameter of the disc 12. The diameter of the frame 30 is between 25 and 35 centimeters. A net 34 is coupled to the first end 32 of the staff 28 by being coupled to the frame 30. A scoop 36 is coupled to a second end 38 of the staff 28. The scoop 36 is planar. The scoop 36 is coplanar with the staff 28. A distal edge 40 of the scoop 36 relative to the second end 38 of the staff 28 is straight and transverse to a longitudinal axis of the staff 28. The scoop 36 may also include a beveled section 50 extending towards the distal edge 40. A length of the distal edge 40 of the scoop 36 relative to the second end 38 of the staff 28 is equal to the diameter of the disc 12. A length of the scoop 36 from the distal edge 40 of the scoop 36 to the second end 38 of the staff 28 is greater than the diameter of the disc 12. The length of the scoop 36 from the distal edge 40 of the scoop 36 to the second end 38 of the staff 28 is between 25 and 35 centimeters. A total length of the staff 28, frame 30, and scoop 36 is between 110 and 130 centimeters.

A plurality of cones 66 may be provided. The cones 66 may be distributed to define a boundaries of a playing surface 68.

The game assembly 10 allows for playing of a game. An example of the game would provide for two players, each of whom has a separate staff 28 as described above. A first player attempts to score by tossing or rolling the disc 12 towards one of the goals 14. Respective point values are awarded for throwing the disc 12 through the goal 14 without making contact, striking an interior surface 46 of one of the straight sides 16 resulting in knocking over the goal 14, and striking an exterior surface 48 of one of the straight sides 16 of the goal 14 resulting in knocking over the goal 14. Points may be subtracted for striking the goal 14 without knocking over the goal 14. A second player may defend against point scoring using the staff 28. The second player may also attempt to retrieve the disc 12 back through the goal 14 after the disc 12 has passed through the goal 14 without knocking over the goal 14. Rules for the manner of retrieval of the disc 12 may be imposed to create a challenge for the second player. For example, the second player must extend the staff 28 through the goal 14 and use the scoop 36 to support carrying the disc 12 back through the goal 14. The disc 12 may also have to be flipped or otherwise transferred from the scoop 36 to the net 34. Successful retrieval of the disc 12 may result in a negation of points to the first player. Other rules may be imposed to vary the nature of the game and use of the staff 28, net 34, scoop 36, disc 12 and goals 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A disc throwing game assembly comprising:

a disc;

a pair of goals, each of said goals comprising a pair of straight sides and a pair of bases, each of said bases being coupled to and extending from a distal end of an associated one of said straight sides relative to a junction of said straight sides;

a staff, said staff being elongated;

a net being coupled to a first end of said staff; and a scoop being coupled to a second end of said staff and wherein each of said bases being planar, each of said bases having a respective bottom surface, said bottom surfaces of said bases of each goal being coplanar; and each said goal having an opening height measured transversely from a base plane defined by said bottom surfaces of said bases to an interior edge of said junction of said straight sides of said goal, said opening height being greater than a diameter of said disc.

2. The assembly of claim 1, further comprising each of said bases being planar, each of said bases having a respective bottom surface, said bottom surfaces of said bases of each goal being coplanar.

3. The assembly of claim 1, further comprising said disc having a diameter between 20 and 30 centimeters.

4. The assembly of claim 3, further comprising a frame coupled to said first end of said staff, said frame being circular, said net being coupled to said frame.

5. The assembly of claim 4, further comprising said frame having a diameter greater than said diameter of said disc.

6. The assembly of claim 5, further comprising said diameter of said frame being between 25 and 35 centimeters.

7. The assembly of claim 3, further comprising said scoop being planar, said scoop further being coplanar with said staff.

8. The assembly of claim 7, further comprising a distal edge of said scoop relative to said second end of said staff being straight and transverse to a longitudinal axis of said staff.

9. The assembly of claim 8, further comprising a length of said scoop from said distal edge of said scoop to said second end of said staff being greater than said diameter of said disc.

10. The assembly of claim 9, further comprising said length of said scoop from said distal edge of said scoop to said second end of said staff being between 25 and 35 centimeters.

11. The assembly of claim 8, further comprising a length of said distal edge of said scoop relative to said second end of said staff being equal to said diameter of said disc.

12. The assembly of claim 3, further comprising a distance between said distal ends of said straight sides of each said goal being greater than said diameter of said disc.

13. The assembly of claim 12, further comprising said distance between said distal ends of said straight sides of each said goal being between 25 and 35 centimeters.

14. The assembly of claim 1, further comprising said opening height of each said goal being between 25 and 35 centimeters.

15. The assembly of claim 1, further comprising said opening height of each said goal being equal to said distance between said distal ends of said straight sides of said goal.

16. A disc throwing game assembly comprising:

a disc, said disc having a diameter between 20 and 30 centimeters;

a pair of goals, each of said goals comprising a pair of straight sides and a pair of bases, each of said bases being coupled to and extending from a distal end of an associated one of said straight sides relative to a junction of said straight sides, each of said bases being planar, each of said bases having a respective bottom surface, said bottom surfaces of said bases of each goal being coplanar, a distance between said distal ends of said straight sides of each said goal being greater than said diameter of said disc, said distance between said distal ends of said straight sides of each said goal being between 25 and 35 centimeters, each said goal having an opening height measured transversely from a base plane defined by said bottom surfaces of said bases to an interior edge of said junction of said straight sides of said goal, said opening height being greater than a diameter of said disc, said opening height of each said goal being between 25 and 35 centimeters, said opening height of each said goal being equal to said distance between said distal ends of said straight sides of said goal;

a staff, said staff being elongated;

a frame coupled to a first end of said staff, said frame being circular, said frame having a diameter greater than said diameter of said disc, said diameter of said frame being between 25 and 35 centimeters;

a net being coupled to said first end of said staff, said net being coupled to said frame;

a scoop being coupled to a second end of said staff, said scoop being planar, said scoop further being coplanar with said staff, a distal edge of said scoop relative to said second end of said staff being straight and transverse to a longitudinal axis of said staff, a length of said distal edge of said scoop relative to said second end of said staff being equal to said diameter of said disc; and a length of said scoop from said distal edge of said scoop to said second end of said staff being greater than said diameter of said disc, said length of said scoop from said distal edge of said scoop to said second end of said staff being between 25 and 35 centimeters.

* * * * *